US007428759B2

(12) United States Patent
Bain et al.

(10) Patent No.: US 7,428,759 B2
(45) Date of Patent: Sep. 30, 2008

(54) PATIENT LIFT WITH SUPPORT LEGS THAT SPREAD OVER TWO RANGES OF MOTION

(75) Inventors: Colin C. Bain, Longmont, CO (US); Nigel Heales, Telford (GB); David Genske, Westminster, CO (US)

(73) Assignee: Joerns Healthcare Inc., Stevens Point, WI (US)

( * ) Notice: Subject to any disclaimer, the term of this patent is extended or adjusted under 35 U.S.C. 154(b) by 269 days.

(21) Appl. No.: 10/911,916

(22) Filed: Aug. 5, 2004

(65) Prior Publication Data

US 2006/0045709 A1 Mar. 2, 2006

(51) Int. Cl.
*A61G 7/10* (2006.01)

(52) U.S. Cl. ..... 5/86.1; 212/294; 212/901; 254/8 R

(58) Field of Classification Search ..... 5/83.1, 5/86.1; 212/294, 901; 254/4 R, 4 C, 8 R, 254/8 C; 74/814
See application file for complete search history.

(56) References Cited

U.S. PATENT DOCUMENTS

| | | | | | |
|---|---|---|---|---|---|
| 686,425 | A * | 11/1901 | Sommerfeld | 5/86.1 |
| 991,886 | A * | 5/1911 | Potter et al. | 74/814 |
| 2,903,238 | A * | 9/1959 | Flandrick | 254/124 |
| 3,149,815 | A * | 9/1964 | Cotter et al. | 248/421 |
| 3,203,009 | A * | 8/1965 | Lundberg | 5/87.1 |
| 3,222,029 | A * | 12/1965 | Hildemann | 254/8 R |
| 3,367,512 | A * | 2/1968 | Kaplan | 212/294 |
| 4,587,871 | A * | 5/1986 | Lahm | 82/120 |
| 4,643,383 | A * | 2/1987 | Fukuta et al. | 248/396 |
| 5,076,448 | A * | 12/1991 | Ballard | 212/294 |
| 5,261,640 | A * | 11/1993 | Yuan | 254/8 B |
| 5,845,348 | A * | 12/1998 | Dunn et al. | 5/83.1 |
| 5,975,826 | A * | 11/1999 | Scholder | 414/444 |
| 6,026,523 | A * | 2/2000 | Simon et al. | 5/81.1 R |
| 6,092,247 | A * | 7/2000 | Wilson | 5/86.1 |
| 6,289,534 | B1 * | 9/2001 | Hakamiun et al. | 5/89.1 |
| 6,665,894 | B2 * | 12/2003 | Moffa et al. | 5/86.1 |
| 6,857,144 | B1 * | 2/2005 | Huang | 5/86.1 |
| 7,003,820 | B1 * | 2/2006 | Iura et al. | 5/83.1 |
| 2002/0069461 | A1 * | 6/2002 | Egan | 5/81.1 R |
| 2002/0101106 | A1 * | 8/2002 | Kim et al. | 297/362.11 |
| 2004/0232396 | A1 * | 11/2004 | Ming-Hwa | 254/8 R |
| 2006/0137091 | A1 * | 6/2006 | Gramkow et al. | 5/86.1 |

* cited by examiner

*Primary Examiner*—James Keenan
(74) *Attorney, Agent, or Firm*—MacMillan, Sobanski & Todd, LLC

(57) ABSTRACT

A portable patient lift has spreadable support legs with a feature that enables the legs of the lift to operate in a first range of motion during operation, and a second range of motion for compact folding.

10 Claims, 11 Drawing Sheets

PATIENT LIFT WITH SUPPORT LEGS THAT SPREAD OVER TWO RANGES OF MOTION

BACKGROUND OF INVENTION

This invention relates in general to hoisting equipment and more particularly, to a portable lifting apparatus for lifting and transferring incapacitated persons.

Lifting devices are well known. Such devices typically include a base, a mast extending upwardly from the base, and a boom extending forwardly from the mast. The boom generally supports a carriage by which the patient can be completely suspended from the lifting device. Rollers depending from the base enable the device and thus the patient to be transferred.

Size (i.e., length and width) of a lifting device contributes to the stability (or instability) of the device and its ability to be easily navigated. The ability of the lift device to be folded into a compact form contributes to its ease of transportation and storage. It is well known to provide lift devices with legs that open and close by operation of a foot pedal. Prior art lifts have legs that operate to open and close over a single range of motion. There is no definitive differentiation between the motion of the legs when the legs are moved to an opened position (i.e., during operation of the lift) and when the legs are moved to the closed position (i.e., during transportation and storage of the lift). If the legs are not sufficiently opened during operation of the lift, the stability of the lift may be affected and the patient's safety may be compromised. If the legs do not close sufficiently, then ease in transportation and storage of the lifting device may be affected.

A portable patient lift is needed with spreadable support legs having a feature that enables the legs to be sufficiently opened during operation of the lift and sufficiently closed into a compact form for transportation and storage.

SUMMARY OF INVENTION

The present invention is directed towards a portable patient lift that has spreadable support legs with a feature that enables the legs of the lift to operate in a first range of motion during operation, and a second range of motion for compact folding.

Various objects and advantages of this invention will become apparent to those skilled in the art from the following detailed description of the preferred embodiment, when read in light of the accompanying drawings.

DETAILED DESCRIPTION

Figure 1:
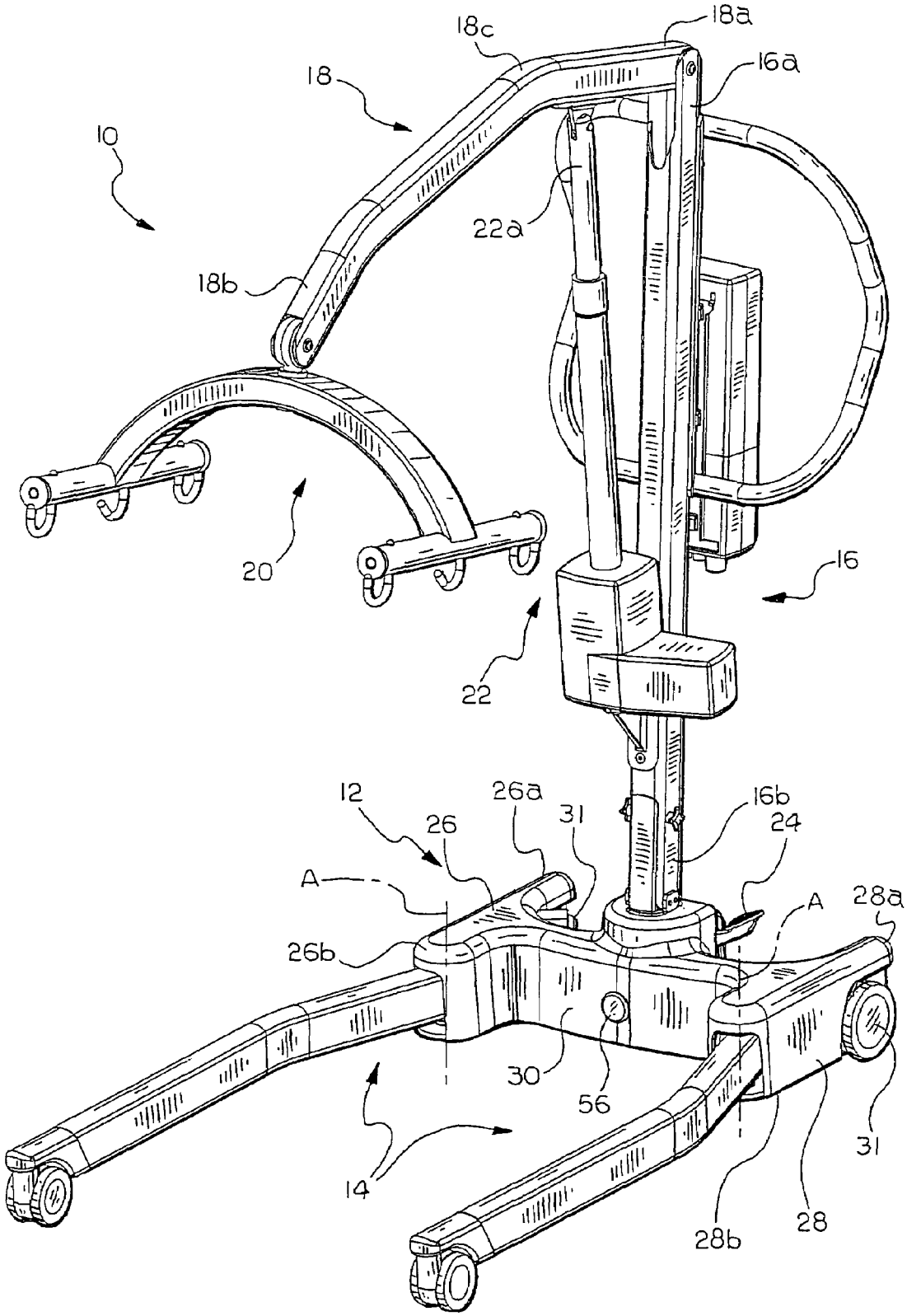
FIG. 1 is a front perspective view of a portable patient lift according to a preferred embodiment of the invention.
Figure 2:
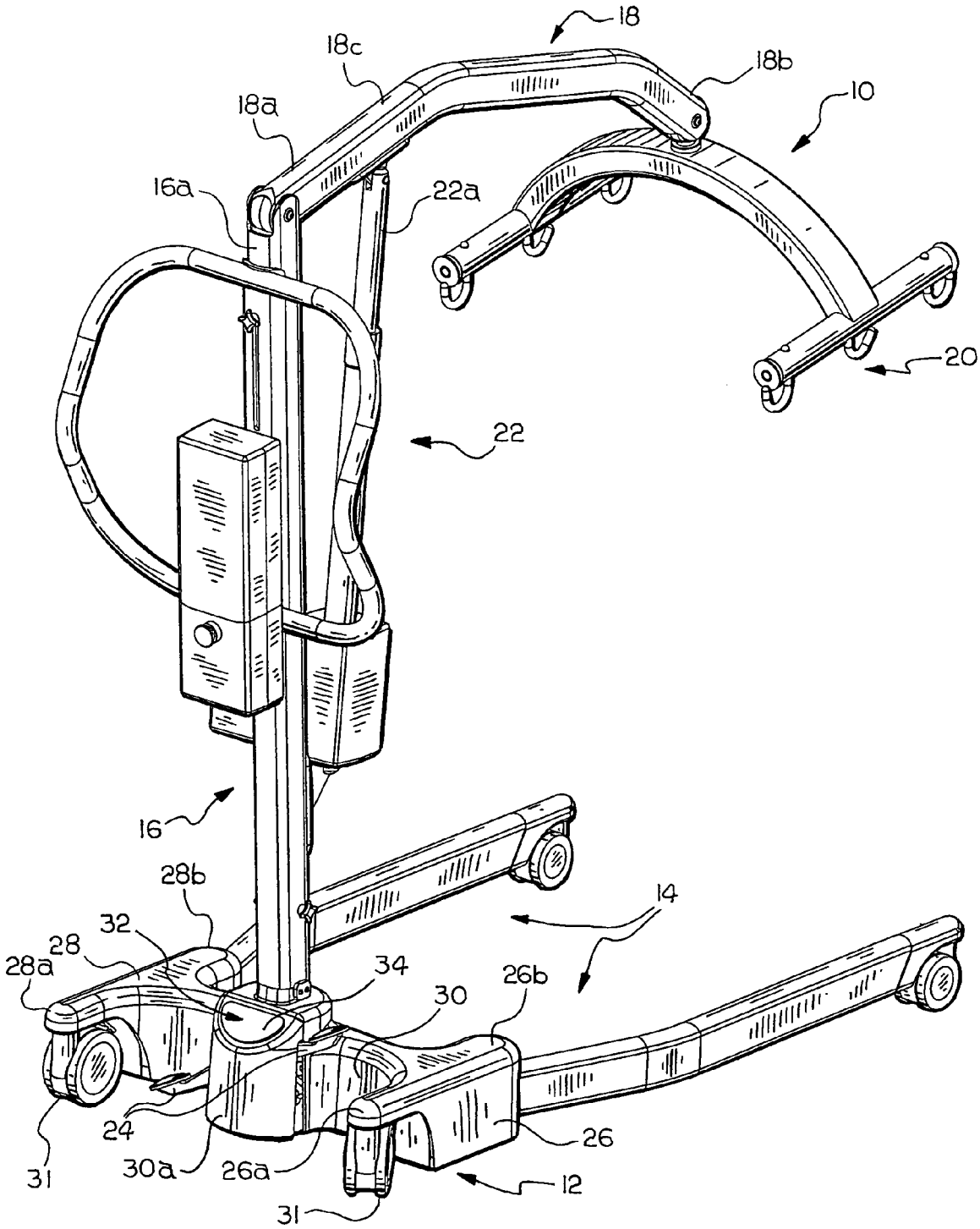
FIG. 2 is a rear perspective view of the portable patient lift illustrated in FIG. 1.

Referring now to the drawings, there is illustrated in FIGS. 1 and 2 a portable lift, generally indicated at 10. The lift 10 preferably includes a base 12, a pair of spreadable support legs 14 extending horizontally from the base 12, a mast 16 extending vertically from the base 12, and a boom 18 extending forwardly from an upper end 16*a* of the mast 16. The mast 16 is preferably not telescopic, but rather a single piece. The boom 18 is pivotally connected at one end 18*a* (shown in FIG. 1) to the mast 16, and the boom 18 has a cradle 20 at its other end 18*b* (shown in FIG. 1) for lifting a patient. An actuator 22 is mounted part way up the height of the mast 16, and is connected at its far end 22*a* (shown in FIG. 1) to an intermediate portion 18*c* (shown in FIG. 1) of the boom 18 so that actuation of the actuator 22 pivots the boom 18 relative to the mast 16.

Figure 3:
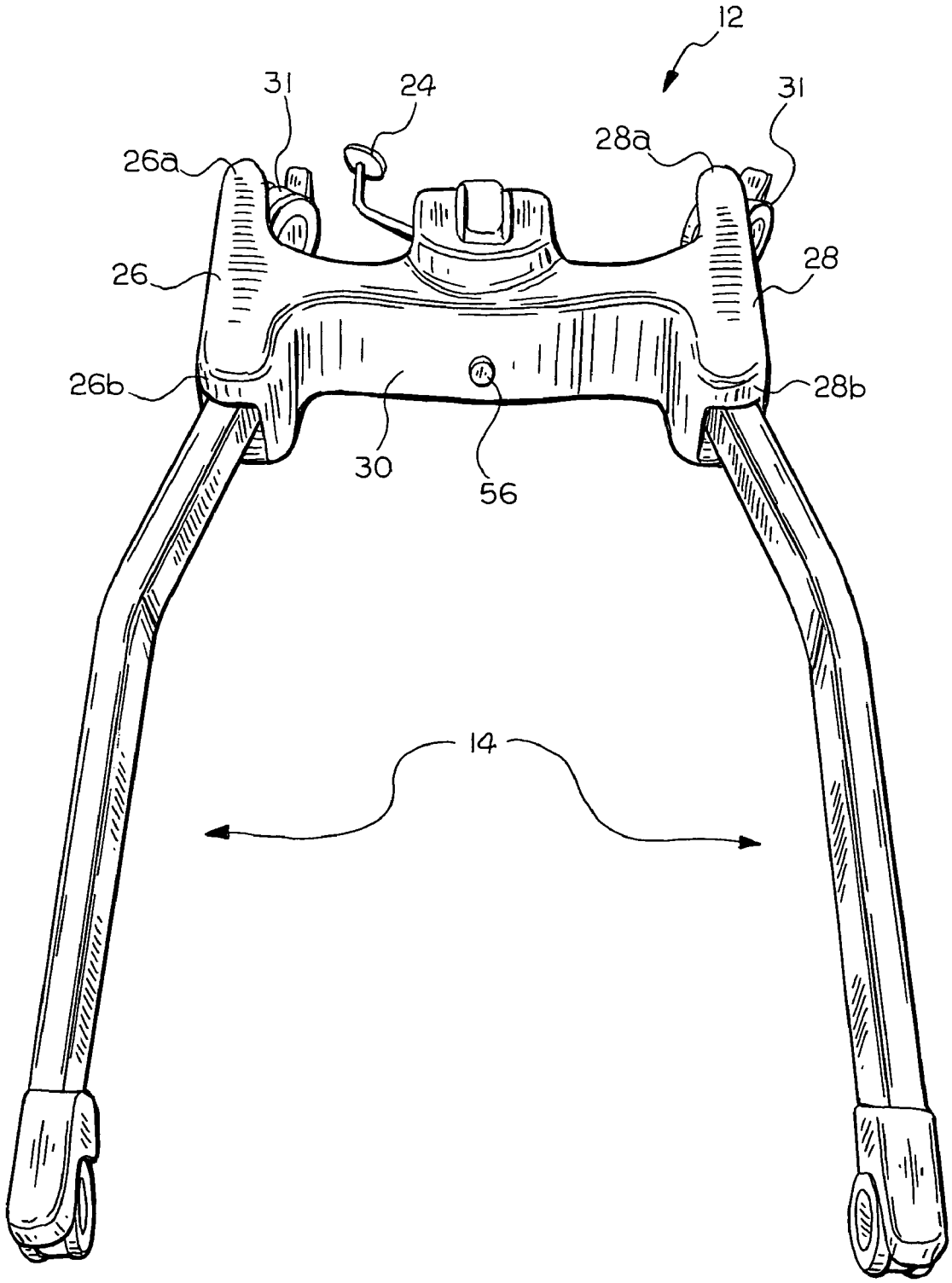
FIG. 3 is a top plan view of the portable patient lift with legs in a first or narrow-open leg position.
Figure 4:
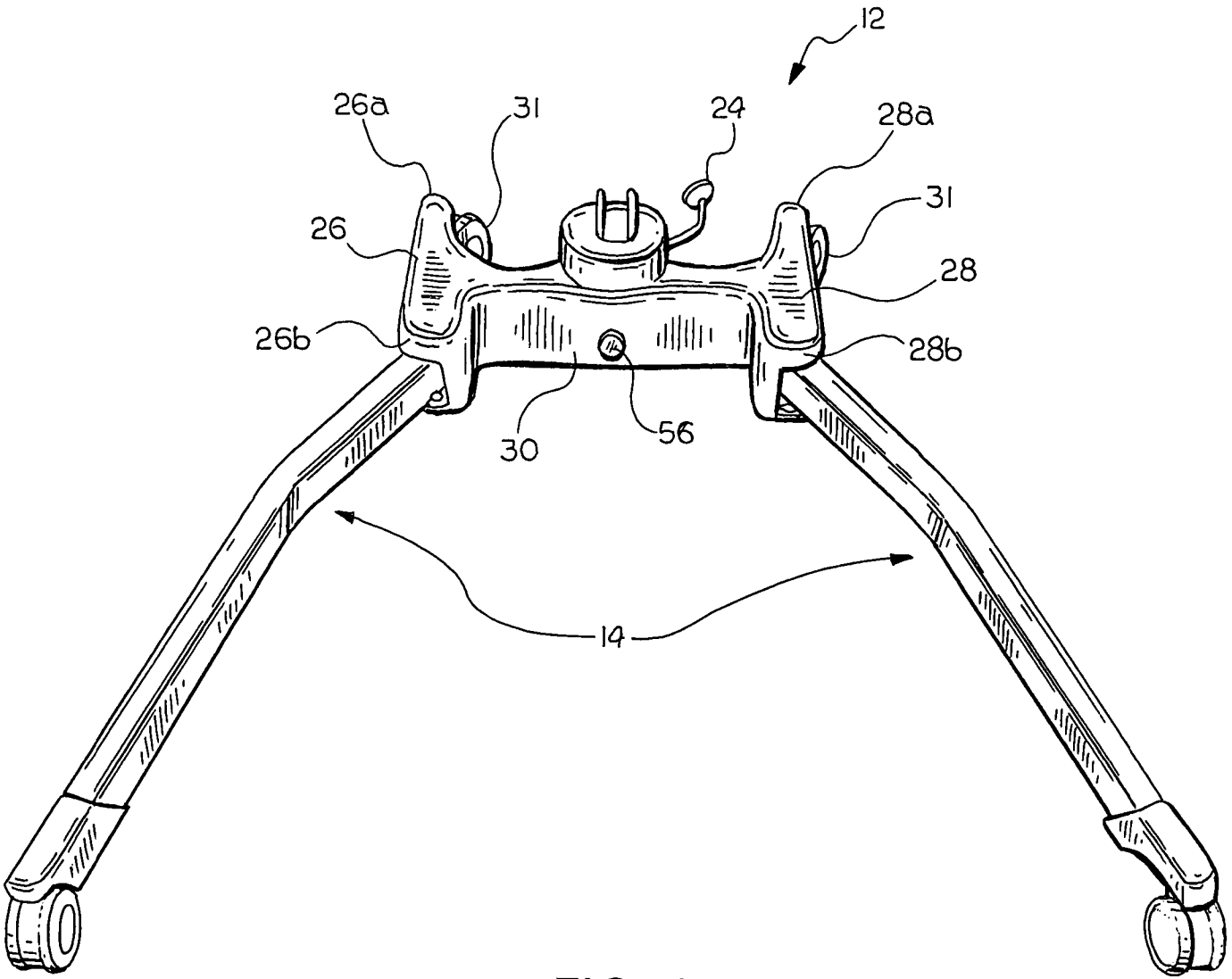
FIG. 4 is a top plan view of the portable patient lift with legs in a second or wide-open leg position.
Figure 5:
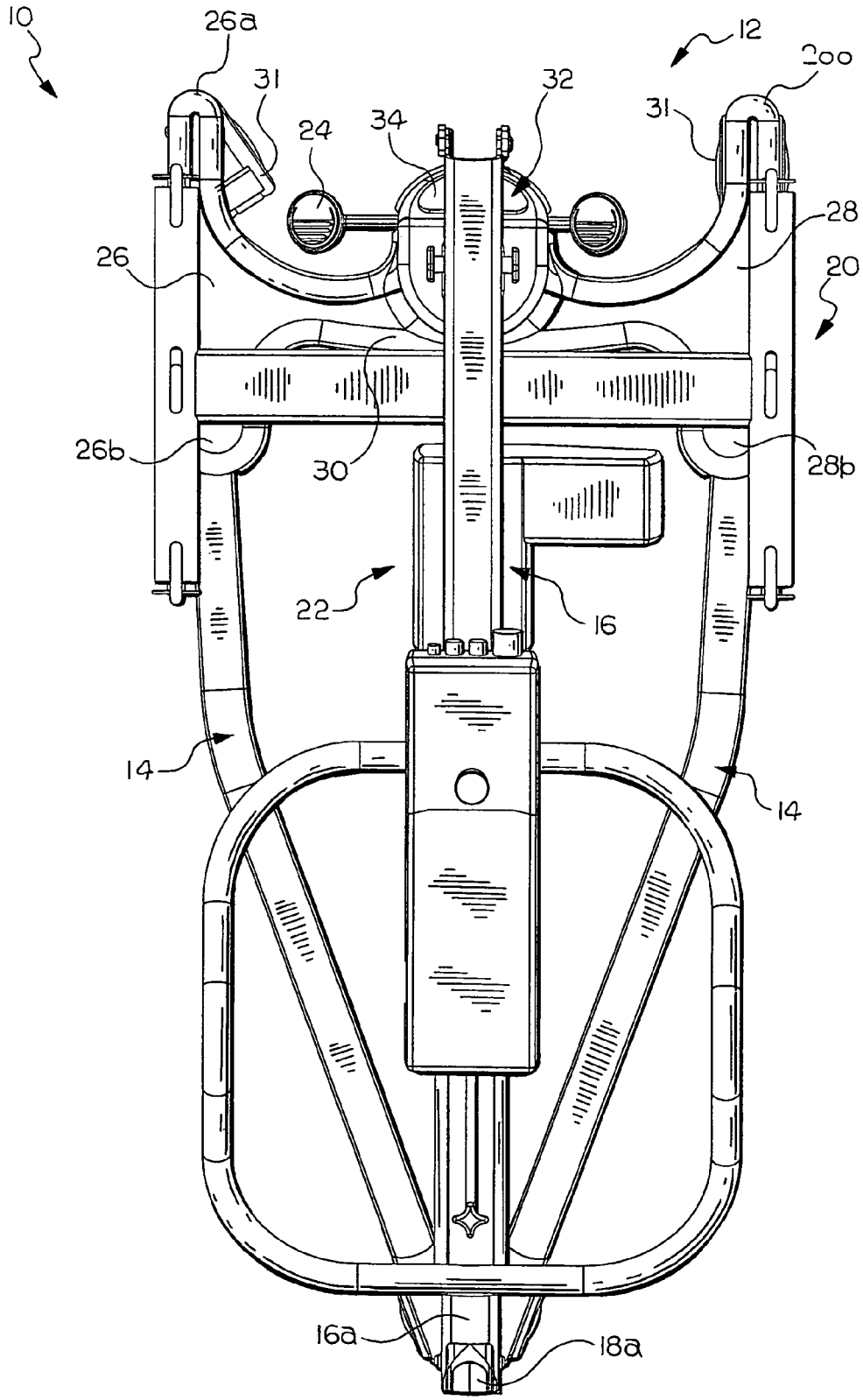
FIG. 5 is a top plan view of the portable patient lift with legs in a folded position so that the lift is in a compact form.

During operation, the support legs 14 can be spread open and closed, as shown in FIGS. 3-5, respectively, to accommodate the operating needs of the lift 10. The opening and closing motion is accomplished by operation of a foot pedal 24. The lift can be folded into a compact form (shown in FIG. 5) by collapsing the support legs 14 together, pivoting the boom 18 down so that it is substantially parallel with the mast 16, and pivoting the mast 16 downward toward or onto the base 12 to assume a position nearly parallel with the support legs 14 and the ground or other support surface.

The illustrated base 12 is generally H-shaped, having left and right blocks 26, 28 oriented in a forward/rearward direction, and having a central connecting body or rib 30 extending laterally between the left and right blocks 26, 28. Each block 26, 28 has a rearward end 26*a*, 28*a* from which caster wheels 31 are mounted for rotation. A forward end 26*b*, 28*b* of the blocks 26, 28 provides a mounting point for the support legs 14, wherein the support legs 14 may be rotatable on a vertical axis A (shown in FIG. 1) for spreading and closing relative to each other.

As illustrated in FIG. 2, the central rib 30 has a rearward side 30*a* (i.e., facing the operator) with an integrated foot push pad 32 with an angled face 34 suitable for the operator to apply foot pressure when moving or manipulating the lift 10. Force from the operator's foot gives the operator extra leverage and/or control when moving or manipulating the lift 10. With the push pad 32 integrated into the base 12, and having a high-friction surface, the operator's foot will be less likely to slip off the base 12 than if no foot push pad were provided.

In operation, the legs 14 operate in a first range of motion during operation, and a second range of motion for compact folding. The legs 14 preferably operate in unison so that when one leg 14 spreads open, the other spreads open as well. As illustrated in FIG. 3, the legs 14 are operable to move to a first or narrow-open leg position. In FIG. 4, the legs 14 are moved to a second or wide-open leg position. In FIG. 5, the legs 14 are closed to a folded position, so that the lift is in a compact form.

Figure 6:
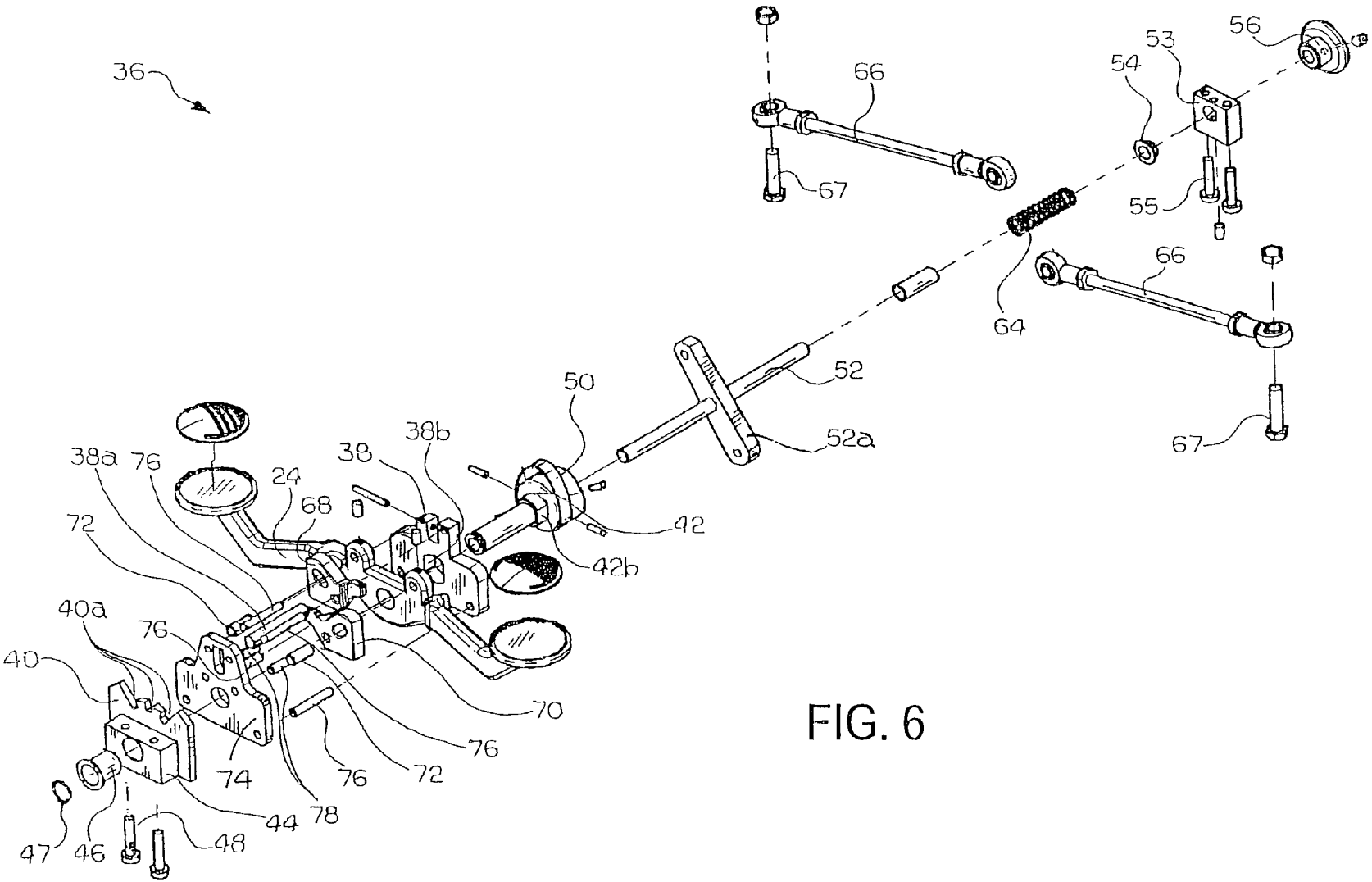
FIG. 6 is an exploded top perspective view of a mechanical controller according to a preferred embodiment of the invention.
Figure 7A:
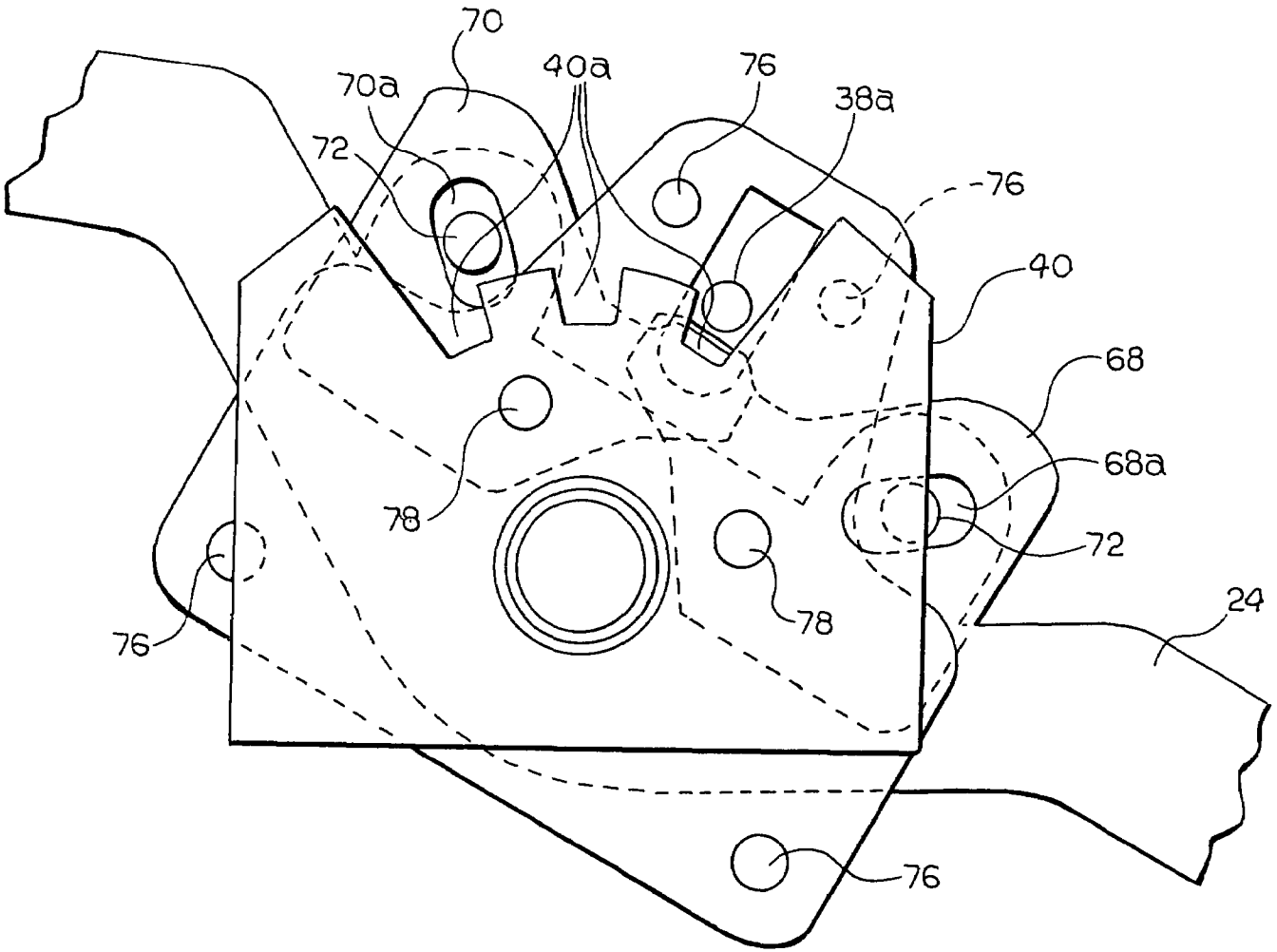
FIGS. 7A-7D are diagrammatic representational views in rear elevation of a portion of the mechanical controller throughout operation thereof.
Figure 7B:
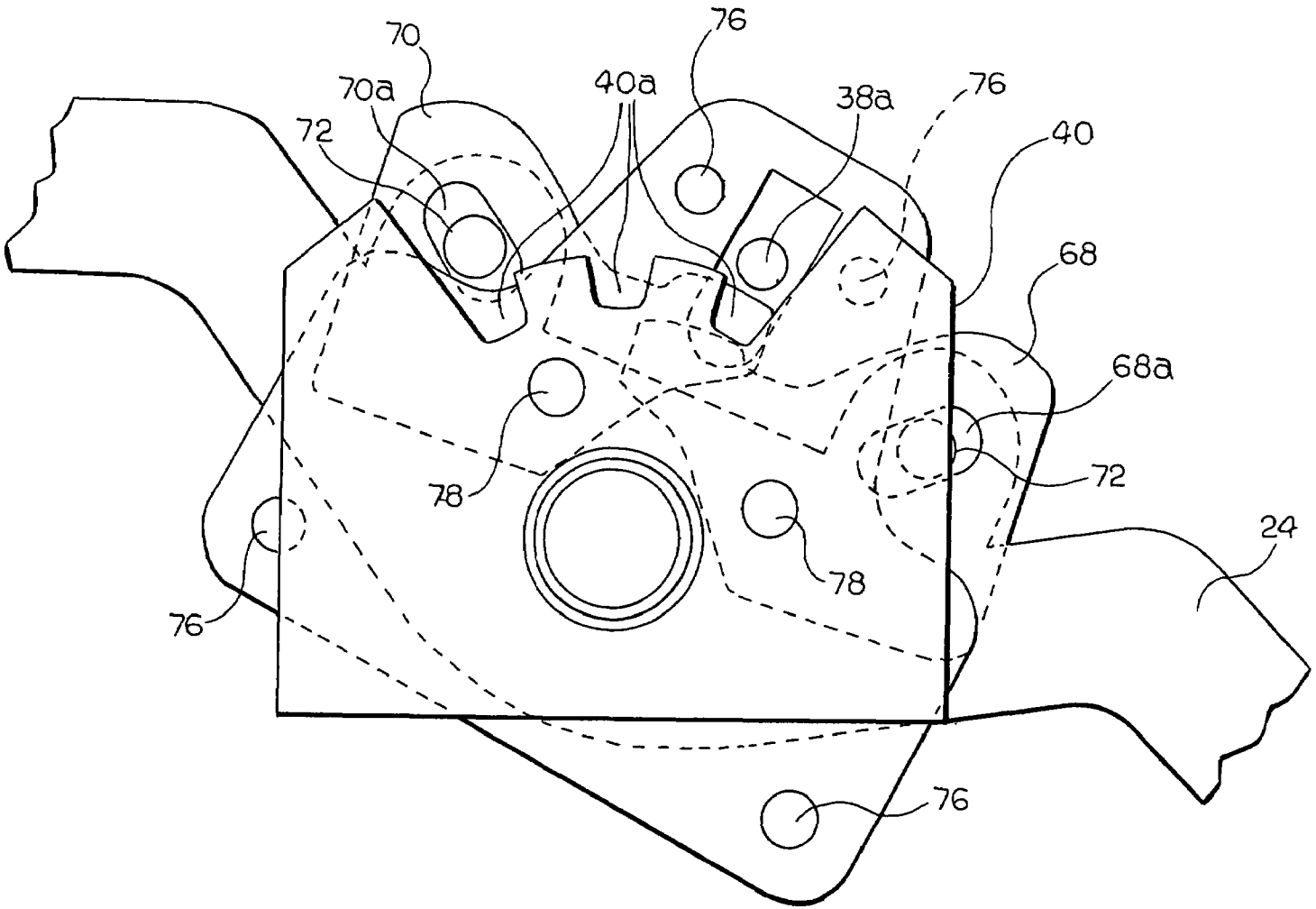
Figure 7C:
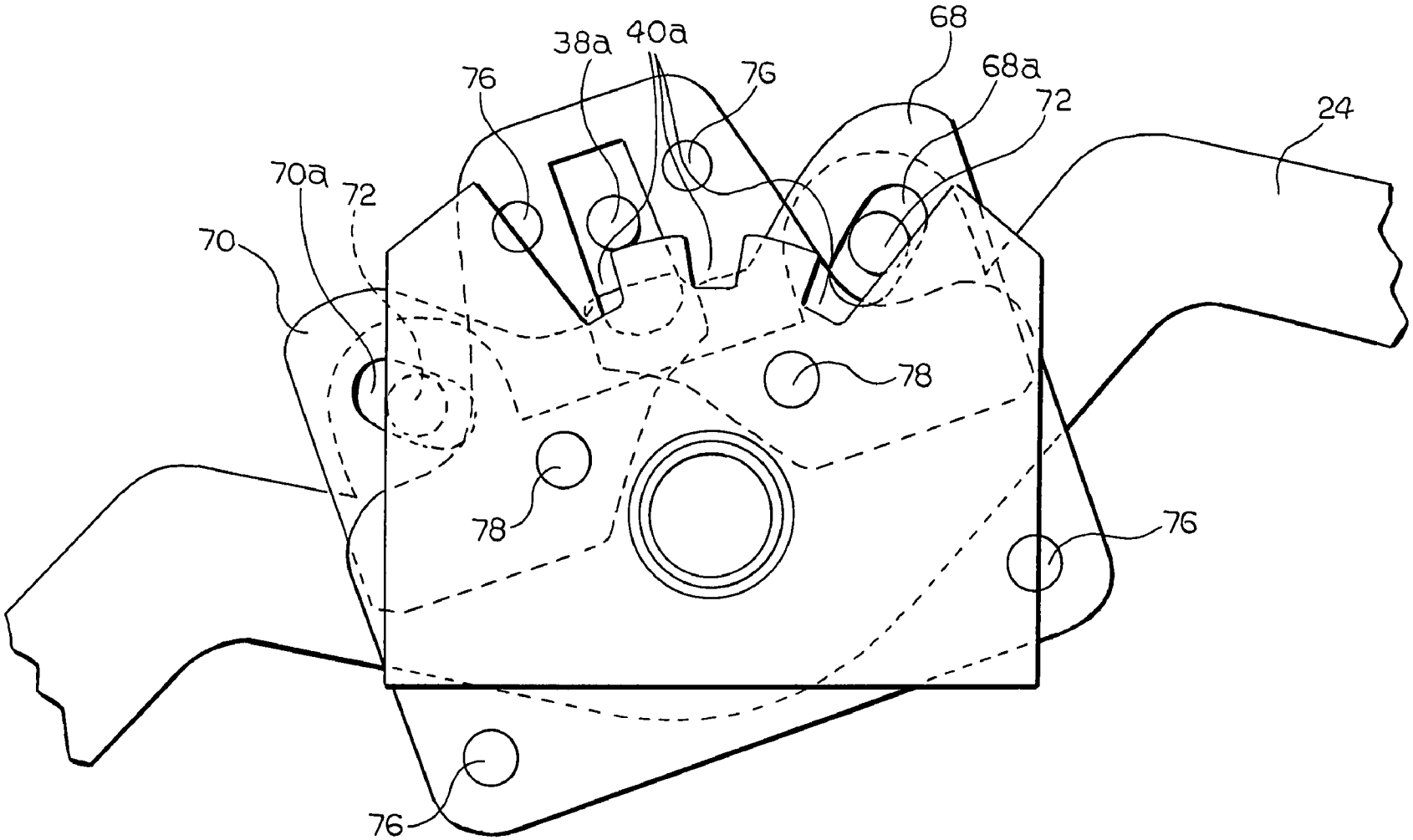
Figure 7D:
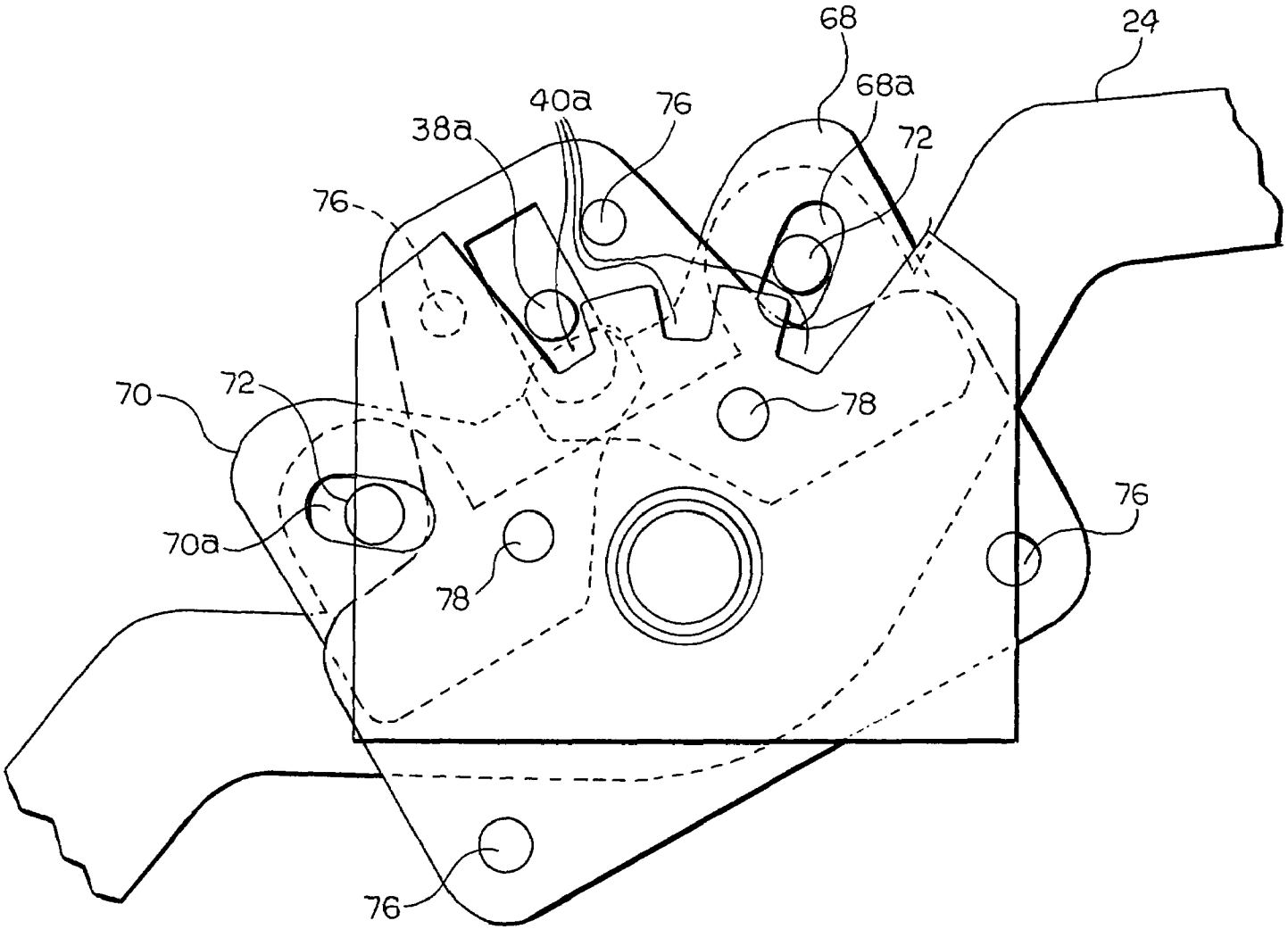

A mechanical controller 36, as shown in FIG. 6, is situated within the rib 30 of the base 12 for controlling the spreading and collapsing of the support legs 14 during operation of the lift. The mechanical controller 36 includes an inboard movable (i.e., rotatable) member or plate 38 with that pivotally supports an engagement pin 38*a* that is selectively engageable with one of a plurality of grooves or slots 40*a* in a fixed or non-movable member or plate 40, as shown in FIGS.

Figure 8:
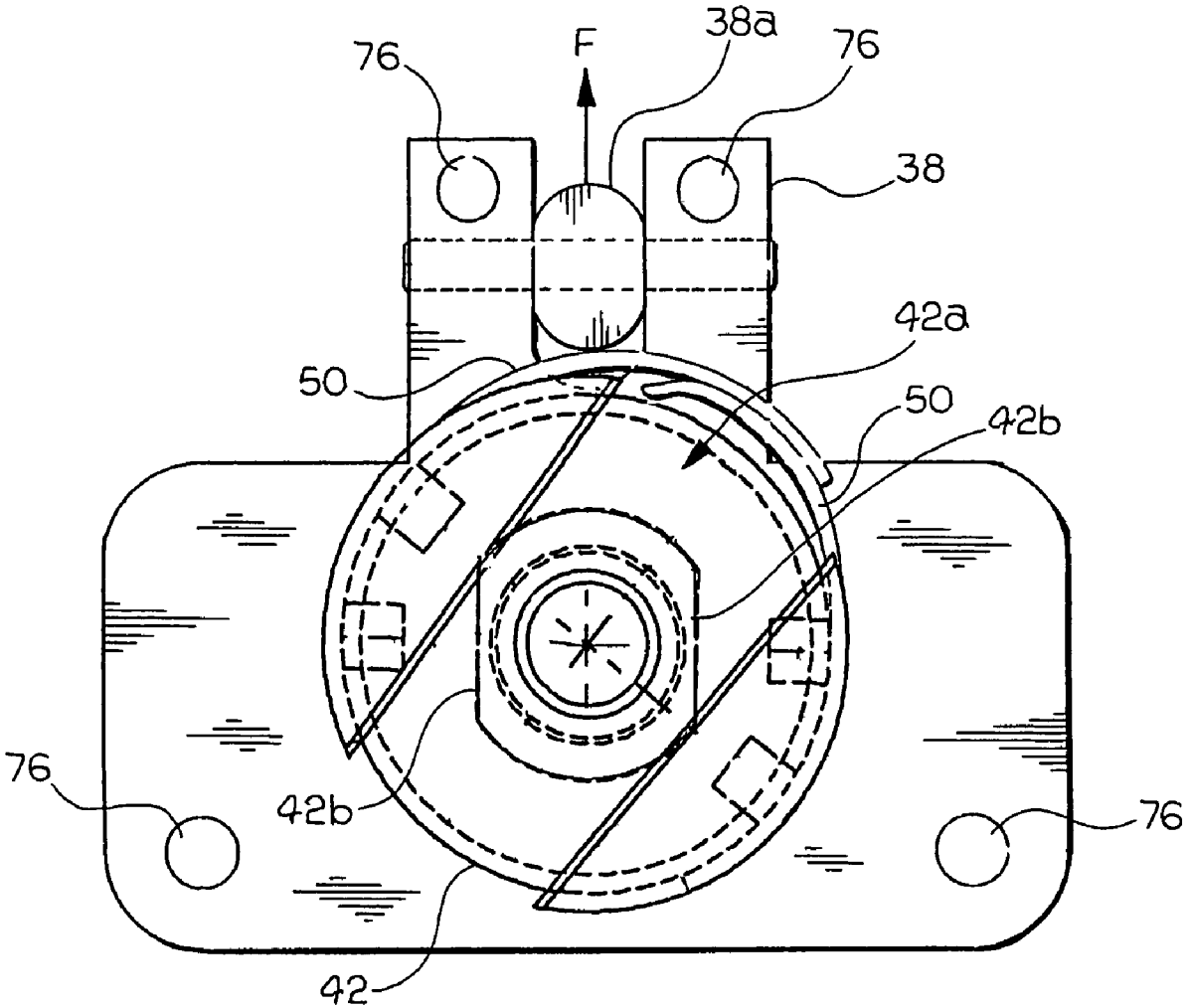
FIG. 8 is a front elevational view of the mechanical controller with a spring thereof engaging an end of an engagement pin to urge an opposing end thereof down.

7A-7D. The inboard movable plate 38 is supported in relation to the fixed plate 40, such as by the leg rotation member 42 shown. The leg rotation member 42 is supported for movement relative to a rear-mounting block 44, such as by the bushing 46 shown, and held in a fixed axial position relative to the rear-mounting block 44, such as by the C-clip 47 shown. The rear-mounting block 44 is held in a fixed relation to the rear end of the rib 30, for example, by threaded fasteners 48. The fixed plate 40 is held in a fixed position relative to the rear-mounting block 44, such as by welding or otherwise fixing the fixed plate 40 to the rear-mounting block 44. One or more springs 50, such as the spring plates shown, are adapted to be held in compression between the leg rotation member 42 and the engagement pin 38*a*, as shown in FIG. 8. The springs 50 operate to urge one end of the engagement pin 38*a* up, which, in turn, urges an opposing end of the engagement pin 38*a* down into one of the slots 40*a* in the fixed plate 40. The engagement pin 38*a* and slot 40*a* cooperate to form an anti-back drive to prevent inadvertent collapse of the legs 14 when the lift 10 is carrying a patient. That is to say, the engagement pin 38*a* is prevented from inadvertently becoming dislodged from the slot 40*a* by a force F exerted on the engagement pin 38*a* by the spring 50.

As shown in the drawings, the front end of the leg rotation member 42 is supported by a slideable shaft 52 that extends through a front-mounting block 53 and further through the front end of the rib 30. The slideable shaft 52 is supported for rotation relative to the front-mounting block 53, such as via the bushing 54 shown. The front-mounting block 53 is held in fixed relation to the front end of the rib 30, for example, by threaded fasteners 55. The slideable shaft 52 extends into the leg rotation member 42. Attached to a portion of the shaft 52, exposed through the front end of the rib 30, is a knob 56. The slideable shaft 52 is operable in a first position, wherein a link 52*a* supported by the slideable shaft 52 engages the leg rotation member 42 to permit the operation of the support legs 14 via the first range of motion, wherein the legs 14 are selectively movable to the first leg position shown in FIG. 3 or the second leg position shown in FIG. 4, as will be explained in the description that follows. By pulling the knob 56 forward in a direction away from the rib 30, the link 52*a* is axially displaced relative to the leg rotation member 42 to permit the operation of the legs 14 via the second range of motion. In the second range of motion, the legs 14 can be fully closed for compact folding, as shown in FIG. 5. A spring 64, which is carried by the shaft 52 between the link 52*a* and the front-mounting block 53, urges or returns the link 52*a* back into engagement with the leg rotation member 42 for displacing the legs 14, as will be clearly understood from the description that follows.

As clearly shown in the drawings, the link 52*a* has opposing ends pivotally connected to opposing tie rods 66, to which the legs 14 are pivotally coupled, such as, for example, via the shoulder bolts 67 shown. The link 52*a* has an irregular shape and is adapted to engage an irregular shaped opening or channel 42*a* (shown in FIG. 8) in the leg rotation member 42. The leg rotation member 42 is fixed relative to the inboard movable plate 38, such as by the flat surfaces 42*b* that engage flat surfaces 38*b* in the inboard movable plate 38. In a preferred embodiment of the invention, the link 52*a* and the channel 42*a* are preferably irregular in shape (e.g., tapered), but may otherwise be configured so as to mate with one another when the link 52*a* and the channel 42*a* are aligned in a particular orientation. When the link 52*a* is engaged with the channel 42*a*, the foot pedals 24 (shown in FIG. 1) via foot action of the operator's foot may rotate the inboard movable plate 38, which in turn rotates the link 52*a* to move the tie rods 66. The tie rods 66, in turn, move the legs 14 in the first range of motion. That is to say, with the link 52*a* engaging the channel 42*a*, the legs 14 can be moved between the first leg position and the second leg position. To move the legs 14 in the second range of motion, wherein the legs can be collapsed to the closed position, the knob 56 is pulled forward and away from the rib 30. This disengages the link 52*a* from the channel 42*a* to allow the link 52*a* to move independently of the channel 42*a* to collapse the legs 14. A spring 64 is held in compression between the front-mounting block 53 and the link 52*a* for urging the link 52*a* back into engagement with the channel 42*a* when the knob 56 is released and the link 52*a* is properly aligned with the channel 42*a*. This once again allows the legs 14 to move in the first range of motion.

The mechanical controller 36 shown includes left and right leg rotation plates 68 and 70 that are supported for sliding movement relative to the foot pedal 24 by leg rotation plate pins 72. The leg rotation plate pins 72 are fixed relative to the foot pedal 24 and displaceable in slots 68*a*, 70*a* in the leg rotation plates 68, 70. An outboard movable plate 74 is held in a fixed position relative to the inboard movable plate 38 by pins 76. The leg rotation plates 68, 70 are pivotally supported relative to the outboard movable plate 74 by pivot pins 78. The inboard and outboard movable plates 38 and 74 house the foot pedal 24 and the leg rotation plates 68, 70 therebetween.

In operation, the engagement pin 38*a* is located in a slot 40*a* in the fixed plate 40. Upon depressing the foot pedal 24 (i.e., in a counter-clockwise direction when viewing FIGS. 7A-7D), the leg rotation plates 68 and 70 rotate upward to engage the engagement pin 38*a* and raise the engagement pin 38*a* out of the slot 40*a*. Further depression of the foot pedal 24 causes the inboard and outboard movable plates 38 and 74 to rotate. Continued depression of the foot pedal 24 causes the engagement pin 38*a* to move in a counter-clockwise direction until the engagement pin 38*a* is radially aligned with another slot 40*a*. Still further depression of the pedal 24 causes the spring 50 to urge an end of the engagement pin 38*a* up, as shown in FIG. 8, which urges the opposite end of the engagement pin 38*a* down into another slot 40*a*. In the former slot 40*a*, the support legs 14 are in the first or narrow-open leg position and in the latter slot 40*a*, the support legs are in the second or wide-open leg position, as discussed above.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A lift portable patient comprising:

a base, a mast extending from the base, a boom extending from the mast, the boom being structured to support a cradle for lifting a patient, support legs extending from the base, a mechanical controller operatively connected to the legs to move the legs throughout a first range of motion between a first spread apart position and a second spread apart position, the mechanical controller having an anti-back drive including a movable member and a fixed member, the movable member pivotally supporting a pin that is selectively engageable with one of a plurality of slots in the fixed member to prevent inadvertent movement of the legs, a disengagement feature operative to disengage the legs from the anti-back drive so as to enable movement of the legs throughout a second range of motion between the second spread apart position and a substantially closed together position, the disengagement feature comprising a slideable shaft supporting a link, the mechanical controller comprising a leg rotation member supported in relation to the slideable shaft, the slideable shaft being operable in a first position, wherein the link engages the leg rotation member to permit the operation of the support legs via the first range of motion, and a second position, wherein the link disengages the leg rotation member to permit the operation of the legs via the second range of motion, the lift being foldable into a compact form for ease of transportation and storage by folding the boom in relation to the mast so that the boom is folded toward the mast and folding the mast in relation to the base so that the mast is folded toward the legs.

2. A lift according to claim 1 wherein disengagement of the legs from the anti-back drive is effected with a control knob.

3. A lift according to claim 1 wherein the legs, when in the first position, are in a wide-open position, and when in the second position, are in a narrow-open position.

4. A lift according to claim 1 wherein one or more springs are adapted to be held in compression against the pin to urge the pin into one of the slots in the fixed member.

5. A lift according to claim 1 wherein the link is connected to the support legs.

6. A lift according to claim 1 further comprising a spring for urging the link back into engagement with the leg rotation member.

7. A lift according to claim 1 wherein the link and the leg rotation member are configured so as to mate with one another when aligned in a particular orientation.

8. A lift according to claim 1 further comprising at least one rotation plate supported relative to a pedal, whereby upon depressing the pedal, the rotation plate engages the pin to raise the pin out of a first one of the slots and causes the movable plate to rotate until the pin is aligned with a second one of the slots, and whereby a spring urges the pin into the second slot.

9. A lift according to claim 1 wherein the mechanical controller is situated within the base.

10. A lift portable patient comprising:

a base, support legs extending from the base, a mast extending from the base, a boom extending from the mast, the boom being structured to support a cradle for lifting a patient, a mechanical controller operatively connected to the legs to move the legs throughout a first range of motion between a first spread apart position and a second spread apart position, the mechanical controller having an anti-back drive to prevent inadvertent movement of the legs, and a disengagement feature operative to disengage the legs from the anti-back drive so as to enable movement of the legs throughout a second range of motion between the second spread apart position and a substantially closed together position, wherein the mechanical controller comprises a leg rotation member and the disengagement feature comprises a slideable shaft supporting the leg rotation member for rotational movement in relation to the base and a link supported in fixed relation to the shaft, the link being engageable with the leg rotation member, the legs being pivotally connected to the base and operatively connected to the link by tie rods, the mechanical controller being operatively connected to a foot pedal that is displaceable to effect movement of the leg rotation member, which in turn effects movement of the link and the tie rods to cause the legs to move about a pivot axis throughout the first range of motion, the slideable shaft being axially displaceable to disengage the link from the leg rotation member to in turn disengage the legs from the mechanical controller to permit the legs to move about the pivot axis throughout the second range of motion, and wherein the lift is foldable into a compact form for ease of transportation and storage by folding the boom in relation to the mast so that the boom is folded toward the mast and folding the mast in relation to the base so that the mast is folded toward the legs.

* * * * *